United States Patent [19]

Buchner et al.

[11] Patent Number: 4,653,661

[45] Date of Patent: Mar. 31, 1987

[54] PACKAGING CONTAINER HAVING A PRESSURE RELIEF VALVE

[75] Inventors: Norbert Buchner, Winnenden; Klaus Domke, Ditzingen, both of Fed. Rep. of Germany

[73] Assignee: Robert Bosch GmbH, Stuttgart, Fed. Rep. of Germany

[21] Appl. No.: 856,542

[22] Filed: Apr. 28, 1986

[30] Foreign Application Priority Data

Jul. 25, 1985 [DE] Fed. Rep. of Germany ..... 3526586

[51] Int. Cl.[4] ..... B65D 51/16

[52] U.S. Cl. ..... 220/209; 220/367; 220/359; 383/103

[58] Field of Search ..... 220/209, 231, 359, 367; 215/260, 310; 206/213.1; 383/94, 103

[56] References Cited

U.S. PATENT DOCUMENTS

| | | | |
|---|---|---|---|
| 2,173,571 | 9/1939 | Jesnig | 220/231 |
| 2,927,722 | 11/1954 | Metzger | 383/94 |
| 3,369,859 | 2/1968 | Cornelius | 206/213.1 |
| 3,621,876 | 11/1971 | Campbell | 220/209 |
| 3,716,180 | 2/1973 | Bemiss et al. | 220/367 |
| 4,210,255 | 7/1980 | Pan | 220/209 |

*Primary Examiner*—George T. Hall

*Attorney, Agent, or Firm*—Edwin E. Greigg

[57] ABSTRACT

A packaging container having a pressure relief valve which is suitable for packaging products that are vulnerable to oxygen and products that give off gases. The packaging container has at least one rigid and flat wall, which is surrounded by an offstanding peripheral flange and on the outside surface of which the pressure relief valve is secured. The pressure relief valve has a flexible membrane, which is secured on the wall in opposed peripheral zones by means of two adhesive strips. With its middle zone, the membrane defines a path and covers an opening in the wall. The opening is located in an indentation by means of which a pressure-action surface of the membrane is provided. A film of oil may be added in the middle zone to assist in preventing entrance of air into the container.

20 Claims, 2 Drawing Figures

PACKAGING CONTAINER HAVING A PRESSURE RELIEF VALVE

BACKGROUND OF THE INVENTION

The invention is based on a packaging container having a pressure relief valve as set forth herein. In a packaging container of this type, known for instance from U.S. Pat. No. 2,927,722, the walls are shaped from a flexible packaging material, and the membrane that forms the valve member is secured on the walls over an opening that has a relatively large cross section. This arrangement has the disadvantage that when the contents of the package includes granular or powdered particles, such as ground coffee, particles of the product can get into the deaeration opening and stick there, making it impossible to close the valve tightly. A further disadvantage, if the contents of the package are not rigid, is that shifting of some of the contents deforms the initially flat wall of the packaging container, with the result that strains arise in the unsecured portion of the membrane that covers the opening, so that the valve cannot be opened unless the internal pressure is high. In that case, the package becomes unattractively deformed, and the consumer will suppose that the goods inside have spoiled.

To avoid strain on the valve membrane caused by deformation of the container wall in packaging containers made from flexible packaging material, a pressure relief valve for a packaging container has been developed, for instance such as that disclosed in European Pat. No. A 23703, in which a membrane forming the valve member is secured on an annular support made from relatively rigid material. The support for the membrane is glued firmly to the container wall and prevents deformation of the membrane when the container walls become deformed.

OBJECT AND SUMMARY OF THE INVENTION

The packaging container according to the invention has the advantage, that when a rigid, flat package wall with a simple valve membrane over it is provided, one is insured that the pressure relief valve can be opened even at a predetermined slight excess pressure in the package, because an indentation about the opening provides a pressure-action surface, which determines the opening pressure. Thus, although the pressure relief valve is of simple design, gas is reliably released from the package even when the excess pressure is only slight, and tight reclosure of the pressure relief valve when the pressure drops to a predetermined level is assured.

The invention will be better understood and further objects and advantages thereof will become apparent from the ensuing detailed description of a preferred embodiment taken in conjunction with the drawings.

DESCRIPTION OF THE PREFERRED EMBODIMENT

Figure 1:
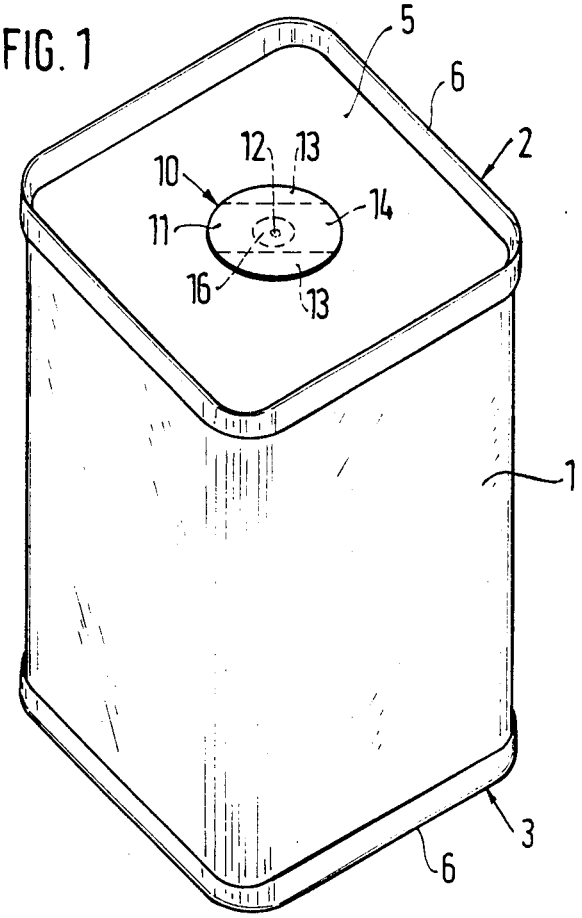
FIG. 1 is a perspective view, illustrating an exemplary embodiment of a packaging container having an pressure relief valve according to the invention.
Figure 2:
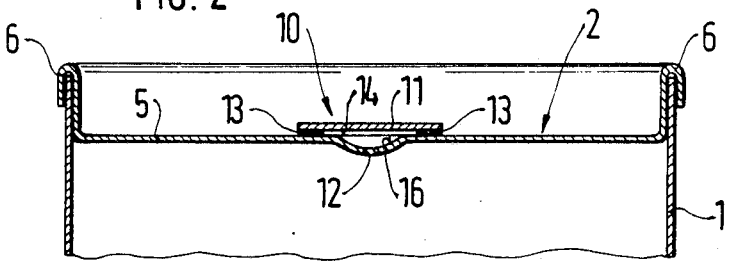
FIG. 2 shows a cross sectional view of the top portion of the top of the packaging container of FIG. 1.

The packaging container comprises a tubular or case-like body 1 with upper and lower lids 2, 3 which closes off the end openings thereof. The package is water-vapor-tight and gas-tight and is particularly suitable for containing food and snack products that are vulnerable to air and moisture.

The body 1 of the packaging container is shaped from a multi-layered packaging material which has a heat-sealable thermoplastic layer on its inside. In the exemplary embodiment shown, the body 1 has a square cross section with rounded corners; alternatively, however, it may also be circular, oval, rectangular or polygonal in cross section, with the corners being curved. The upper and lower lids 2, 3 closing off the end openings of the body 1 have a flat wall 5 and a U-shaped folding rim 6, adapted to the cross-sectional shape of the body 1. The rim 6 is folded over the ends of the body 1 to engage them and is tightly sealed to the inside and outside thereof. The upper and lower lids 2, 3 are shaped by deep drawing a multi-layered relatively rigid sheet of packaging material that likewise has a heat-sealable thermoplastic layer on its inside. Preferably, the material from which the lids and body are made also has a layer acting as a gas and water vapor barrier, for instance made of aluminum.

To prevent ambient air from getting into the interior of the container and causing spoilage of the product that is sensitive to oxygen, on the one hand, and on the other hand to keep gas produced by the packaged product, such as freshly roasted coffee, kefir, yogurt, and so forth, from escaping from the package interior, the container is equipped with a pressure relief valve 10. Also, the pressure valve prevents deformation or even bursting of the container. This pressure relief valve 10 is preferably disposed on the top lid 2, on the flat wall 5 thereof, so that the upwardly off standing folding rim 6 protects it from externally applied pressure caused by other packages or articles in the vicinity. The pressure relief valve 10 has a membrane 11 of a flexible plastic foil 30 μm in thickness. The surface of the membrane 11 is preferably circular, but it can also be square with rounded corners. The membrane 11 rests on the wall 5 of the lid 2 and closes off an opening 12 in the wall of the lid 2. In peripheral zones opposite one another, the membrane 11 is secured on the top of the lid 2 by means of two parallel strips 13 of adhesive applied to the surface which adheres to the lid 2. With its middle zone, located between the two adhesive strips 13, the membrane 11 defines the top of a path 14, which is defined at the bottom of the top surface of the wall 5 of the lid 2.

The opening 12 in the wall 5 of the lid 2 has a relatively small width, so as to allow gas to pass through it, but not particles of the product in the container; it is preferably produced by punching a slit in the top surface of the container. In order to provide a pressure-action surface on the membrane 11 which is continuously exposed to the pressure in the interior of the container, the flat wall 5 of the lid 2 is indented inward toward the interior of the packaging container all around the opening 12. The indentation 16 is in the shape of a spherical segment or cone. The width or diameter of the indentation 16 where it begins is approximately equivalent to the width of the path 14 or to the distance by which the two adhesive strips 13 are spaced apart; depending on the desired opening pressure of the pressure relief valve 10, this width is in a range of from 5 to 10 mm. The maximum depth of the indentation 16 is approximately 0.5 to 1 mm. In order to prevent the diffusion of ambient air through the path 14 closed off by the membrane 11, a fluid sealant, such as silicon oil, is introduced into the path.

To avoid leaks in the pressure relief valve 10 caused by unequal heat expansion on the part of the membrane 11 and wall 5 in response to changes in temperature, a material is selected which has a heat expansion coefficient approximately equal to that of the material making up the lid 2.

The pressure relief valve 10 described herein functions as follows: Through the opening 12 in the wall 5 of the lid 2, the pressure prevailing in the interior of the packaging container acts upon the surface of the membrane 11 that coincides with the indentation 16. At a pressure over approximately 5 mbar, the middle zone of the membrane 11, which covers the path 14, bulges out so that the path 14 widens, and gas can escape from the interior of the package along the path 14. Once a quantity of gas has been released, causing a corresponding pressure drop in the interior of the package, the middle zone of the membrane 11 that covers the path 14 returns into contact with the top surface of the wall 5, due to atmospheric pressure, and the film of fluid formed by the sealant also seals off the pressure relief valve 10 in a gas-tight manner.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A packaging container having a pressure relief valve, including a valve member in the form of a flexible membrane, which is secured on one wall of the packaging container to close off an opening and to define a deaeration path, characterized in that said packaging container includes a rigid, flat wall, an indentation in said flat wall, an opening of relatively small cross section in said indentation, said flexible membrane secured to said flat wall over said indentation along two peripheral zones opposite one another that define an unsecured path along which excess gas in said container that escapes through said opening can escape, whereby said membrane will reseal upon escape of sufficient gas.

2. A packaging container as defined in claim 1, characterized in that the width of the indented area is approximately equivalent to the width of the unsecured path.

3. A packaging container as defined by claim 2, characterized in that the indented area takes the form of a cone.

4. A packaging container as defined by claim 3, characterized in that the indented area takes the form of a spherical segment.

5. A packaging container as defined by claim 1, characterized in that said flexible membrane is secured to the wall of the packaging container by means of two parallel adhesive strips between which said unsecured path is formed.

6. A packaging container as defined by claim 2, characterized in that said flexible membrane is secured to the wall of the packaging container by means of two parallel adhesive strips between which said unsecured path is formed.

7. A packaging container as defined by claim 3, characterized in that said flexible membrane is secured to the wall of the packaging container by means of two parallel adhesive strips between which said unsecured path is formed.

8. A packaging container as defined by claim 4, characterized in that said flexible membrane is secured to the wall of the packaging container by means of two parallel adhesive strips between which said unsecured path is formed.

9. A packaging container as defined by claim 1, characterized in that said opening in said indentation is a puncture.

10. A packaging container as defined by claim 2, characterized in that said opening in said indentation is a puncture.

11. A packaging container as defined by claim 3, characterized in that said opening in said indentation is a puncture.

12. A packaging container as defined in claim 4, characterized in that said opening in said indentation is a puncture.

13. A packaging container as defined by claim 1, characterized in that said rigid wall on which said pressure relief valve is formed has a protruding circumferential rim.

14. A packaging container as defined by claim 2, characterized in that said rigid wall on which said pressure relief valve is formed has a protruding circumferential rim.

15. A packaging container as defined by claim 3, characterized in that said rigid wall on which said pressure relief valve is formed has a protruding circumferential rim.

16. A packaging container as defined by claim 4, characterized in that said rigid wall on which said pressure relief valve is formed has a protruding circumferential rim.

17. A packaging container as defined by claim 1, which includes a film of fluid sealant in said unsecured path.

18. A packaging container as defined by claim 2, which includes a film of fluid sealant in said unsecured path.

19. A packaging container as defined by claim 3, which includes a film of fluid sealant in said unsecured path.

20. A packaging container as defined by claim 4, which includes a film of fluid sealant in said unsecured path.

* * * * *